US012686906B2

(12) United States Patent
Kim et al.

(10) Patent No.: US 12,686,906 B2
(45) Date of Patent: Jul. 21, 2026

(54) HIGH-STRENGTH AUSTENITIC STAINLESS STEEL WITH IMPROVED LOW-TEMPERATURE TOUGHNESS IN HYDROGEN ENVIRONMENT

(71) Applicant: POSCO Co., Ltd, Pohang-si (KR)

(72) Inventors: Kwangmin Kim, Pohang-si (KR); Kyung-Hun Kim, Pohang-si (KR); Han-Seop Noh, Ulsan (KR)

(73) Assignee: POSCO CO., LTD, Pohang-si (KR)

( * ) Notice: Subject to any disclaimer, the term of this patent is extended or adjusted under 35 U.S.C. 154(b) by 480 days.

(21) Appl. No.: 18/037,524

(22) PCT Filed: Nov. 1, 2021

(86) PCT No.: PCT/KR2021/015496
§ 371 (c)(1),
(2) Date: May 17, 2023

(87) PCT Pub. No.: WO2022/108173
PCT Pub. Date: May 27, 2022

(65) Prior Publication Data

US 2024/0018637 A1 Jan. 18, 2024

(30) Foreign Application Priority Data

Nov. 23, 2020 (KR) ..... 10-2020-0158159

(51) Int. Cl.

| | |
|---|---|
| ***C22C 38/58*** | (2006.01) |
| ***C21D 6/00*** | (2006.01) |
| ***C21D 8/02*** | (2026.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/48*** | (2006.01) |

(52) U.S. Cl.
CPC ..... *C22C 38/58* (2013.01); *C21D 6/004* (2013.01); *C21D 6/005* (2013.01); *C21D 6/008* (2013.01); *C21D 8/02* (2013.01); *C21D 8/0226* (2013.01); *C21D 8/0263* (2013.01); *C21D 9/46* (2013.01); *C22C 38/001* (2013.01); *C22C 38/02* (2013.01); *C22C 38/04* (2013.01); *C22C 38/42* (2013.01); *C22C 38/44* (2013.01); *C22C 38/48* (2013.01); *C21D 2211/001* (2013.01)

(58) Field of Classification Search
None
See application file for complete search history.

(56) References Cited

U.S. PATENT DOCUMENTS

| | | | | |
|---|---|---|---|---|
| 2005/0178477 | A1 | 8/2005 | Igarashi et al. | |
| 2007/0267107 | A1* | 11/2007 | Michler | C22C 38/04 148/327 |
| 2016/0281187 | A1* | 9/2016 | Matsumoto | C22C 38/44 |

FOREIGN PATENT DOCUMENTS

| | | | |
|---|---|---|---|
| CN | 103476959 | A | 12/2013 |
| CN | 110191972 | A | 8/2019 |
| CN | 110499448 | A | 11/2019 |
| CN | 111212928 | A | 5/2020 |
| EP | 2042616 | A1 | 4/2009 |
| JP | S60-009862 | A | 1/1985 |
| JP | H08-269547 | A | 10/1996 |
| JP | 2005-179699 | A | 7/2005 |
| JP | 2016-183412 | A | 10/2016 |
| JP | 2017-008413 | A | 1/2017 |
| JP | 2018-135592 | A | 8/2018 |
| JP | 6684620 | B2 | 4/2020 |
| JP | 2020-196912 | A | 12/2020 |
| KR | 10-1543938 | B1 | 8/2015 |
| KR | 10-2018-0054031 | A | 5/2018 |
| WO | 2015/087376 | A1 | 6/2015 |
| WO | 2017/111251 | A1 | 6/2017 |
| WO | 2020/101227 | A1 | 5/2020 |

OTHER PUBLICATIONS

Office Action dated Nov. 29, 2024, issued in corresponding Chinese Patent Application No. 202180078476.5 with an English translation.
Extended European Search Report dated Sep. 26, 2024, issued in corresponding European Patent Application No. 21894944.4.
Office Action dated Nov. 7, 2024, issued in corresponding Korean Patent Application No. 10-2023-0067348 with an English translation.
Japanese Office Action dated May 28, 2024 issued in Japanese Patent Application No. 2023-530923 (with English translation).
Office Action dated Apr. 17, 2025 issued in corresponding Chinese Patent Application No. 202180078476.5 with the English translation.
International Search Report dated Feb. 25, 2022 issued in International Patent Application No. PCT/KR2021/015496 (with English translation).
Chinese Office Action dated Jun. 28, 2025 issued in Chinese Patent Application No. 202180078476.5 (with English translation).

* cited by examiner

*Primary Examiner* — Jenny R Wu
(74) *Attorney, Agent, or Firm* — Morgan Lewis & Bockius LLP

(57) ABSTRACT

Disclosed is a high-strength austenitic stainless steel with improved low-temperature toughness in a hydrogen environment. The austenitic stainless steel with improved low-temperature toughness in a hydrogen environment includes, in percent by weight (wt %), 0.1% or less of C, 1.5% or less of Si, 0.5 to 3.5% of Mn, 17 to 23% of Cr, 8 to 14% of Ni, 0.15 to 0.3% of N, and the balance of Fe and impurities, and optionally further includes at least one of 2% or less of Mo, 0.2 to 2.5% of Cu, 0.05% or less of Nb, and 0.05% or less of V, and the number of precipitates having an average diameter of 30 to 1000 nm and distributed in a microstructure is 20 or less per 100 $\mu m^2$.

1 Claim, No Drawings

HIGH-STRENGTH AUSTENITIC STAINLESS STEEL WITH IMPROVED LOW-TEMPERATURE TOUGHNESS IN HYDROGEN ENVIRONMENT

CROSS-REFERENCE OF RELATED APPLICATIONS

This application is the U.S. National Phase under 35 U.S.C. § 371 of International Patent Application No. PCT/KR2021/015496, filed on Nov. 1, 2021 which claims priority to and the benefit of Korean Application No. 10-2020-0158159 filed on Nov. 23, 2020, the entire contents of which are incorporated herein by reference.

TECHNICAL FIELD

The present disclosure relates to a high-strength austenitic stainless steel with improved low-temperature toughness in a hydrogen environment.

BACKGROUND ART

Since emission of greenhouse gases ($CO_2$, $NO_X$, and $SO_X$) has been suppressed in recent years in order to prevent global warming, the development and distribution fuel cell vehicles using hydrogen as a fuel is expanding. Accordingly, there is a need to develop a material used in containers and components for storing hydrogen.

Hydrogen storage containers are classified into containers for storing liquid hydrogen and containers for storing gaseous hydrogen according to the state of hydrogen. Particularly, methods for storing liquid hydrogen may be used in various fields in the future due to higher storage efficiency than methods for storing gaseous hydrogen. For example, the methods for storing liquid hydrogen may be used for long-distance transportation of hydrogen from abroad to the country or for large-scale storage of hydrogen in hydrogen stations and hydrogen production facilities.

Hydrogen is stored at different temperatures according to the state thereof. Although hydrogen in a gas state may generally be stored at room temperature, hydrogen is cooled to a temperature of about −60 to −40° C. before being stored in a storage tank. This is to prevent an excessive increase in temperature caused by charging of hydrogen, and hydrogen gas is cooled using a precooler in consideration of an increase in the temperature of hydrogen gas during charging.

Liquid hydrogen is stored in a cryogenic environment below −253° C. Also, steel materials are exposed to a temperature range of −253° C. to room temperature in a device for vaporizing liquid hydrogen. Therefore, in determining steel materials used in hydrogen storage tanks, deterioration of physical properties of steel materials caused by hydrogen not only at room temperature but also in a cryogenic environment is an important factor in determining a steel material.

Meanwhile, in order to realize and develop a hydrogen energy society based on fuel cell vehicles in the future, it is essential to reduce costs of fuel cell vehicles or hydrogen stations by decreasing size of various devices. That is, amounts of steel materials used in hydrogen environments need to be reduced. Therefore, improved mechanical strength and corrosion resistance are required in steel materials used in hydrogen environments.

Currently, 304L and 316L stainless steels, which are austenitic stainless steels, are widely used in gaseous and liquid hydrogen environments. Physical properties of these steel materials tend to deteriorate as temperature decreases. Particularly, a decrease in toughness is a major problem occurring at a low temperature. In addition, when a steel material is exposed to a hydrogen environment, hydrogen penetrates into the steel material, and thus deterioration in physical properties caused by hydrogen may further be added. Therefore, deterioration in physical properties caused by temperature should be determined together with deterioration in physical properties caused by hydrogen.

RELATED ART DOCUMENT (Patent Document 1) Korean Patent Laid-open Publication No. 10-2013-0067007 (Published on Jun. 21, 2013).

DISCLOSURE

Technical Problem

Provided is a high-strength austenitic stainless steel having a high impact toughness in a cryogenic environment and improved low-temperature toughness in a hydrogen environment by adjusting the composition of alloying elements.

Technical Solution

In accordance with an aspect of the present disclosure, the austenitic stainless steel according to an embodiment of the present disclosure includes, in percent by weight (wt %), 0.1% or less of C, 1.5% or less of Si, 0.5 to 3.5% of Mn, 17 to 23% of Cr, 8 to 14% of Ni, 0.15 to 0.3% of N, and the balance of Fe and impurities, and selectively further includes 2% or less of Mo, 0.2 to 2.5% of Cu, 0.05% or less of Nb, and 0.05% or less of V, wherein the number of precipitates having an average diameter of 30 to 1000 nm and distributed in a microstructure is 20 or less per 100 $\mu m^2$.

In addition, in the austenitic stainless steel according to an embodiment of the present disclosure, a yield strength at room temperature may be 300 MPa or more.

In addition, in the austenitic stainless steel according to an embodiment of the present disclosure, a Charpy impact energy value, measured at −196° C. after charging hydrogen into the steel material at 300° C. and at 10 MPa, may be 100 J or more.

In addition, in the austenitic stainless steel according to an embodiment of the present disclosure, a difference between a first Charpy impact energy value measured without charging with hydrogen at a temperature below −50° C. and a second Charpy impact energy value measured after charging with hydrogen at 300° C. and at 10 MPa may be 30 J or less.

Advantageous Effects

According to an embodiment of the present disclosure, a high-strength austenitic stainless steel having improved hydrogen embrittlement resistance may be provided.

Best Mode

The austenitic stainless steel according to an embodiment of the present disclosure includes, in percent by weight (wt %), 0.1% or less of C, 1.5% or less of Si, 0.5 to 3.5% of Mn, 17 to 23% of Cr, 8 to 14% of Ni, 0.15 to 0.3% of N, and the balance of Fe and impurities, and optionally further includes one of one of 2% or less of Mo, 0.2 to 2.5% of Cu, 0.05% or less of Nb, and 0.05% or less of V, wherein the number of precipitates having an average diameter of 30 to 1000 nm and distributed in a microstructure is 20 or less per 100 $\mu m^2$.

MODES OF THE INVENTION

Hereinafter, embodiments of the present disclosure will be described in detail with reference to the accompanying drawings. The embodiments of the present disclosure may, however, be embodied in many different forms and should not be construed as being limited to the embodiments set forth herein. Rather, these embodiments are provided so that this disclosure will be thorough and complete, and will fully convey the concept of the invention to those skilled in the art.

Also, the terms used herein are merely used to describe particular embodiments. An expression used in the singular encompasses the expression of the plural, unless otherwise indicated. Throughout the specification, the terms such as "including" or "having" are intended to indicate the existence of features, operations, functions, components, or combinations thereof disclosed in the specification, and are not intended to preclude the possibility that one or more other features, operations, functions, components, or combinations thereof may exist or may be added.

Meanwhile, unless otherwise defined, all terms used herein have the same meaning as commonly understood by one of ordinary skill in the art to which this disclosure belongs. Thus, these terms should not be interpreted in an idealized or overly formal sense unless expressly so defined herein. As used herein, the singular forms are intended to include the plural forms as well, unless the context clearly indicates otherwise.

The terms "about", "substantially", etc. used throughout the specification means that when a natural manufacturing and a substance allowable error are suggested, such an allowable error corresponds the value or is similar to the value, and such values are intended for the sake of clear understanding of the present invention or to prevent an unconscious infringer from illegally using the disclosure of the present invention.

Steel materials exposed to a hydrogen environment are likely to be exposed to various temperature ranges as well as the hydrogen environment. Thus, temperature may be an important factor in applying a steel material to a hydrogen environment.

In general, as temperature decreases, toughness of a steel material decreases and the steel material becomes embrittled. Particularly, in a hydrogen atmosphere, major problems may be caused not only by deterioration in physical properties due to temperature but also by embrittlement occurring due to hydrogen. Therefore, effects of hydrogen and temperature on a steel material should be evaluated together in order to select the steel material used in a hydrogen environment.

Meanwhile, as methods used to increase strength of steel materials, cold working and precipitation strengthening by precipitates have been used.

However, a cold working method causes transformation of austenite into martensite, and hydrogen embrittlement may be caused by martensite formed by transformation or deterioration in toughness at a low-temperature may occur.

According to the method using precipitation strengthening by precipitates, a problem of deteriorating toughness in a cryogenic environment may occur due to the precipitates. In addition, an increase in strength by precipitation strengthening causes additional costs for a precipitate production process.

Therefore, rather than the increase in strength by the cold working or precipitation strengthening, there is a need to develop an austenite structure with high stability and high strength by adjusting the composition of alloying elements.

The present disclosure provides a high-strength strength austenitic stainless steel having low-temperature toughness in a hydrogen environment, wherein the strength is improved by solid strengthening effects and stability of austenite is improved in the hydrogen environment by adjusting the composition of alloying elements of the steel.

The high-strength austenitic stainless steel with improved low-temperature toughness in a hydrogen environment according to an embodiment of the present disclosure includes, in percent by weight (wt %), 0.1% or less of C, 1.5% or less of Si, 0.5 to 3.5% of Mn, 17 to 23% of Cr, 8 to 14% of Ni, 0.15 to 0.3% of N, and the balance of Fe and impurities, and optionally further includes at least one of 2% or less of Mo, 0.2 to 2.5% of Cu, 0.05% or less of Nb, and 0.05% or less of V.

Hereinafter, reasons for numerical limitations on the contents of alloying elements in the embodiment of the present disclosure will be described. Hereinafter, the unit is wt % unless otherwise stated.

Carbon (C): 0.1% or Less

C is an element effective on increasing strength by stabilizing an austenite phase, inhibiting formation of delta (δ) ferrite, and enhancing solid-solution strengthening. However, an excess of C may induce intergranular precipitation of Cr carbides, resulting in deterioration of ductility, toughness, and corrosion resistance. Therefore, the C content may be controlled to 0.1% or less.

Silicon (Si): 1.5% or Less

Si is an element effective on improving corrosion resistance and solid-solution strengthening. However, an excess of Si may promote formation of delta (δ) ferrite in cast steels, resulting in not only deterioration of hot workability of a steel material but also deterioration of ductility and toughness of the steel material. Therefore, the Si content may be controlled to 1.5% or less.

Manganese (Mn): 0.5 to 3.5%

Mn, as an austenite phase-stabilizing element, inhibits formation of strain-induced martensite, resulting in improvement of cold rollability. Thus, the Mn content may be controlled to 0.5% or more. However, an excess of Mn over 3.5% may cause an increase in formation of S-based inclusions (MnS) resulting in deterioration of ductility, toughness, and corrosion resistance of steel materials. Therefore, the Mn content may be controlled to a range of 0.5 to 3.5%.

Chromium (Cr): 17 to 23%

Cr, as an element required to obtain corrosion resistance, is added in an amount of 17% or more. However, an excess of Cr over 23% may promote formation of a delta (δ) ferrite in a slab resulting in deterioration of hot workability of a steel material. Also, a large amount of Ni needs to be added to stabilize the austenite phase, so that manufacturing costs may increase. Therefore, the Cr content may be controlled to a range of 17 to 23%.

Nickel (Ni): 8 to 14%

Ni, as an austenite phase-stabilizing element, is added in an amount of 8% or more to obtain low-temperature toughness. However, addition of a large amount of Ni, which is a high-priced element, increases costs of raw materials, and thus an upper limit thereof is controlled to 14%. Therefore, the Ni content may be controlled to a range of 8 to 14%.

Nitrogen (N): 0.15 to 0.3%

Because addition of N increases effects on stabilizing an austenite phase and increasing strength of a steel material, N is added in an amount of 0.15% or more. However, since an excess of N decreases hot workability, an upper limit thereof is controlled to 0.3%. Therefore, the N content may be controlled to a range of 0.15 to 0.3%.

Molybdenum (Mo): 2% or Less

Mo, as a ferrite-stabilizing element, improves resistance to general corrosion and pitting corrosion in various acid solutions, and increases a passivated region against corrosion of a steel material. However, an excess of Mo promotes formation of delta (δ) ferrite, resulting in deterioration of low-temperature toughness of a steel material. Also, formation of a sigma phase may be promoted to deteriorate mechanical properties and corrosion resistance, and thus an upper limit thereof is controlled to 2%. Therefore, the Mo content may be controlled to 2% or less.

Copper (Cu): 0.2 to 2.5%

Cu, as an austenite phase-stabilizing element, is effective on softening a steel material and thus needs to be added in an amount of 0.2% or more. However, Cu increases manufacturing costs of a steel material, and an excess of Cu forms a low-melting point phase to deteriorate hot workability, resulting in quality degradation. Accordingly, an upper limit thereof is controlled to 2.5%. Therefore, the Cu content may be controlled to a range of 0.2 to 2.5%.

Niobium (Nb) and vanadium (V): 0.05% or Less

Nb and V are precipitation-hardening elements binding to carbon or nitrogen. Addition of these elements may prevent formation of Cr precipitates during a cooling process of cold annealing. In addition, by inhibiting formation of Cr precipitates in a welded part, deterioration of corrosion resistance may be prevented.

However, when the contents of Nb and V exceed 0.05%, these elements are crystallized as nitrides in a molten steel during casting resulting in clogging of casting nozzles, and crystal grains are refined to reduce hot workability. Therefore, the contents of Nb and V may be controlled to 0.05% or less.

The remaining component of the composition of the present disclosure is iron (Fe). However, the composition may include unintended impurities inevitably incorporated from raw materials or surrounding environments, and thus addition of other alloy components is not excluded. The impurities are not specifically mentioned in the present disclosure, as they are known to any person skilled in the art of manufacturing.

In the austenitic stainless steel according to an embodiment of the present disclosure having the above-described composition of alloying elements, the number of precipitates having an average diameter of 30 to 1000 nm and distributed in a microstructure is 20 per 100 $\mu m^2$. As used herein, the precipitates refer to all precipitates formed in a steel and include precipitates of a mono-component or multi-component carbonitrides of Cr, Nb, and V and precipitates of a metal such as Cu.

In addition, the austenitic stainless steel according to an embodiment of the present disclosure may have a yield strength of 300 MPa or more at room temperature.

When an object is pulled with a force greater than a certain level, the object cannot return to the original state thereof but remains in an extended state even after the force is removed. In this case, a maximum strength of the object to return to the original state thereof is referred to as yield strength. When strength of a steel material is increased, an amount of the steel material used to manufacture an article with the same strength may be reduced, and thus an effect on reducing manufacturing costs of the article may be obtained.

In addition, the austenitic stainless steel according to an embodiment of the present disclosure may have a Charpy impact energy value of 100 J or more when measured at a temperature of −196° C. or below after hydrogen is charged in the steel material under the conditions of 300° C. and 10 MPa.

Charpy impact energy value is a value obtained by the Charpy impact test. The Charpy impact test consists of striking a specimen, which has a thickness of 10 mm and is notched at the center, with a hammer in a state of being mounted on a tester at different temperatures.

In addition, the austenitic stainless steel according to an embodiment of the present disclosure may satisfy a difference of 30 J or less between a first Charpy impact energy value measured at a temperature below −50° C. without charging with hydrogen and a second Charpy impact energy value measured after charging with hydrogen under the conditions of 300° C. and 10 MPa.

When the difference between the Charpy impact energy value of the uncharged material and the Charpy impact energy value of the hydrogen-charged material is 30 J or less, it may be considered that deterioration of physical properties caused by hydrogen is negligible, and thus there is no problem in using the material in a hydrogen environment.

Hereinafter, the present disclosure will be described in more detail through examples. However, it is necessary to note that the following examples are only intended to illustrate the present disclosure in more detail and are not intended to limit the scope of the present disclosure.

EXAMPLES

Austenitic slabs having the compositions of alloying elements shown in Table 1 below were hot-rolled, and the hot-rolled steel sheets were annealed at a temperature of 900 to 1,200° C. The compositions of the alloying elements of the examples and comparative examples are as shown in Table 1 below.

TABLE 1

| | Composition of alloying elements (wt %) | | | | | | | | |
|---|---|---|---|---|---|---|---|---|---|
| | C | Si | Mn | Cr | Ni | Mo | Cu | N | Nb, V |
| Example 1 | 0.03 | 0.4 | 3.2 | 18.6 | 9.2 | — | — | 0.16 | — |
| Example 2 | 0.02 | 0.6 | 1.3 | 17.5 | 10.2 | 0.2 | — | 0.18 | — |
| Example 3 | 0.03 | 0.5 | 1.0 | 18.5 | 11.0 | — | — | 0.15 | — |
| Example 4 | 0.02 | 0.4 | 0.8 | 21.2 | 10.4 | 0.5 | 0.7 | 0.21 | — |
| Example 5 | 0.02 | 0.5 | 0.9 | 21.4 | 10.5 | 0.6 | — | 0.20 | — |
| Example 6 | 0.02 | 0.6 | 1.5 | 18.3 | 8.1 | — | — | 0.16 | — |
| Example 7 | 0.03 | 1.0 | 1.2 | 19.4 | 12.7 | — | 0.2 | 0.21 | — |
| Example 8 | 0.03 | 0.8 | 1.5 | 20.5 | 13.8 | — | — | 0.19 | — |
| Example 9 | 0.03 | 1.4 | 2.5 | 20.9 | 12.6 | — | — | 0.22 | — |
| Example 10 | 0.02 | 1.0 | 0.9 | 22.7 | 10.6 | 0.8 | — | 0.21 | — |
| Example 11 | 0.02 | 0.7 | 1.7 | 20.6 | 11.3 | 0.4 | 2.1 | 0.20 | — |
| Example 12 | 0.02 | 0.9 | 0.6 | 19.2 | 13.1 | 1.8 | — | 0.18 | — |
| Example 13 | 0.02 | 1.3 | 1.0 | 19.6 | 9.5 | 0.6 | — | 0.21 | — |
| Example 14 | 0.03 | 1.1 | 0.8 | 20.3 | 9.8 | 0.4 | — | 0.16 | 0.03Nb |
| Example 15 | 0.02 | 1.0 | 0.9 | 21.2 | 10.3 | 0.5 | — | 0.21 | — |
| Example 16 | 0.03 | 0.7 | 1.2 | 21.0 | 10.5 | 0.7 | 0.5 | 0.15 | — |
| Example 17 | 0.03 | 0.8 | 0.9 | 21.3 | 10.7 | — | 0.8 | 0.19 | — |
| Example 18 | 0.04 | 0.8 | 0.9 | 21.8 | 10.3 | — | — | 0.21 | — |
| Example 19 | 0.02 | 1.2 | 1.3 | 20.8 | 9.6 | 0.4 | 0.5 | 0.20 | — |
| Example 20 | 0.03 | 1.0 | 1.1 | 21.1 | 10.4 | — | — | 0.25 | — |
| Comparative | 0.02 | 0.5 | 1.1 | 18.1 | 8.1 | — | — | 0.04 | — |

TABLE 1-continued

| | Composition of alloying elements (wt %) | | | | | | | | |
|---|---|---|---|---|---|---|---|---|---|
| | C | Si | Mn | Cr | Ni | Mo | Cu | N | Nb, V |
| Example 1 | | | | | | | | | — |
| Comparative Example 2 | 0.03 | 1.7 | 1.1 | 20.1 | 8.2 | — | — | 0.06 | — |
| Comparative Example 3 | 0.03 | 0.9 | 0.7 | 18.5 | 8.1 | 3.2 | — | 0.03 | — |
| Comparative Example 4 | 0.03 | 1.1 | 0.5 | 17.8 | 6.0 | — | — | 0.03 | — |
| Comparative Example 5 | 0.02 | 1.0 | 2.9 | 22.0 | 10.8 | — | — | 0.20 | 0.22Nb |
| Comparative Example 6 | 0.02 | 1.0 | 3.0 | 22.1 | 10.9 | — | — | 0.20 | 0.28Nb 0.20V |
| Comparative Example 7 | 0.02 | 0.2 | 3.1 | 22.0 | 11.1 | — | — | 0.15 | 0.49Nb |

Table 2 below show Charpy impact energy values of examples and comparative examples when hydrogen is charged or not charged. The Charpy impact energy values were obtained by using specimens obtained according to the ASTM E23 type A standards at room temperature (25° C.), at −50° C., at −100° C., at −150° C., and at −196° C. by an impact test. Hydrogen was charged in the steel type in an environment of a temperature of 300° C. and a pressure of 10 MPa.

The specimen may be evaluated as having improved cryogenic toughness when the Charpy impact energy value is 100 J or more at −196° C. When the Charpy impact energy value is 100 J or more at −196° C. even after the specimen is charged with hydrogen, high impact toughness may be obtained even in a liquid hydrogen environment.

All of the specimens of Examples 1 to 20 exhibited Charpy impact energy values of 100 J or more at 25° C., −50° C., −100° C., −150° C., and −196° C. before charged with hydrogen. In addition, even after the specimens were charged with hydrogen, improved low-temperature and cryogenic toughness were obtained because the Charpy impact energy values of 100 J or more were obtained at all temperature ranges.

On the contrary, the specimens of Comparative Examples 2 to 4 exhibited Charpy impact energy values below 100 J at −196° C. after charged with hydrogen. This is because stability of austenite was deteriorated by adding an excess of the ferrite-stabilizing element. Low Charpy impact energy values below 100 J were obtained at −196° C. according to Comparative Examples 5 to 7 in both cases of hydrogen-charged and uncharged specimens.

Table 3 below shows differences of Charpy impact energy values of examples and comparative examples between hydrogen-charged cases and uncharged cases and numbers of precipitates in an area of 100 $\mu m^2$ and yield strengths.

The difference in Charpy impact energy values depending on charging with hydrogen indicates deterioration of physical properties of a steel material caused by hydrogen. When the difference in the Charpy impact energy values is 30 J or less, it may be considered that physical properties were not deteriorated by hydrogen.

Precipitates were analyzed after collecting the precipitates by using carbon extraction replica. The carbon extraction replica is a method of analyzing a sample by dissolving a matrix using an appropriate etchant to allow precipitates or inclusions to slightly protrude to prepare a replica, and detaching the replica together with the precipitates or inclusions by further etching the matrix before detaching the replica.

TABLE 2

| | Uncharged | | | | | Hydrogen-Charged | | | | |
|---|---|---|---|---|---|---|---|---|---|---|
| | −196° C. | −150° C. | −100° C. | −50° C. | 25° C. | −196° C. | −150° C. | −100° C. | −50° C. | 25° C. |
| Example 1 | 158 | 172 | 207 | 250 | 317 | 130 | 149 | 185 | 233 | 305 |
| Example 2 | 162 | 189 | 217 | 251 | 334 | 136 | 169 | 199 | 241 | 319 |
| Example 3 | 158 | 188 | 213 | 238 | 327 | 131 | 160 | 190 | 220 | 313 |
| Example 4 | 208 | 237 | 282 | 333 | 447 | 188 | 230 | 277 | 347 | 448 |
| Example 5 | 197 | 224 | 268 | 316 | 423 | 178 | 212 | 261 | 310 | 418 |
| Example 6 | 163 | 173 | 215 | 305 | 342 | 138 | 149 | 194 | 290 | 329 |
| Example 7 | 229 | 251 | 297 | 348 | 458 | 224 | 245 | 294 | 350 | 455 |
| Example 8 | 230 | 248 | 298 | 345 | 449 | 223 | 245 | 302 | 343 | 445 |
| Example 9 | 232 | 248 | 305 | 351 | 453 | 230 | 242 | 307 | 350 | 451 |
| Example 10 | 205 | 223 | 261 | 312 | 420 | 187 | 209 | 249 | 304 | 411 |
| Example 11 | 220 | 247 | 296 | 341 | 445 | 218 | 243 | 301 | 338 | 444 |
| Example 12 | 211 | 232 | 284 | 322 | 430 | 201 | 220 | 277 | 313 | 423 |
| Example 13 | 198 | 218 | 265 | 301 | 415 | 177 | 200 | 255 | 286 | 403 |
| Example 14 | 134 | 167 | 195 | 251 | 318 | 108 | 147 | 181 | 232 | 302 |
| Example 15 | 201 | 225 | 258 | 310 | 412 | 182 | 207 | 248 | 296 | 397 |
| Example 16 | 185 | 221 | 264 | 301 | 418 | 162 | 202 | 249 | 292 | 405 |
| Example 17 | 204 | 234 | 281 | 324 | 445 | 186 | 214 | 266 | 310 | 439 |
| Example 18 | 196 | 226 | 271 | 324 | 429 | 173 | 211 | 261 | 308 | 419 |
| Example 19 | 172 | 193 | 238 | 310 | 421 | 152 | 177 | 225 | 301 | 407 |
| Example 20 | 227 | 248 | 289 | 331 | 449 | 221 | 243 | 281 | 333 | 448 |
| Comparative Example 1 | 170 | 183 | 210 | 253 | 318 | 130 | 145 | 180 | 227 | 283 |
| Comparative Example 2 | 124 | 162 | 199 | 241 | 311 | 76 | 123 | 168 | 217 | 286 |
| Comparative Example 3 | 98 | 146 | 178 | 224 | 298 | 41 | 92 | 132 | 187 | 264 |
| Comparative Example 4 | 128 | 165 | 195 | 238 | 308 | 90 | 123 | 159 | 210 | 281 |
| Comparative Example 5 | 73 | 99 | 143 | 179 | 223 | 55 | 78 | 124 | 158 | 206 |
| Comparative Example 6 | 50 | 59 | 90 | 125 | 180 | 29 | 35 | 70 | 101 | 161 |
| Comparative Example 7 | 49 | 59 | 81 | 110 | 165 | 25 | 32 | 52 | 84 | 144 |

Then, the number of collected precipitates was measured using a transmission electron microscope (TEM). The number of precipitates was obtained by calculating precipitates observed in an area of 100 $\mu m^2$, and the precipitates were from 30 to 1,000 nm in size.

TABLE 3

| | Charged-uncharged | | | | | Number of precipitates/area | Yield strength |
|---|---|---|---|---|---|---|---|
| Example | −196° C. | −150° C. | −100° C. | −50° C. | 25° C. | (count/100 $\mu m^2$) | (MPa) |
| Example 1 | 28 | 23 | 22 | 17 | 12 | <1 | 338 |
| Example 2 | 26 | 20 | 18 | 10 | 15 | <1 | 368 |
| Example 3 | 27 | 28 | 23 | 18 | 14 | <1 | 321 |
| Example 4 | 20 | 7 | 5 | −14 | −1 | <1 | 402 |
| Example 5 | 19 | 12 | 7 | 6 | 5 | <1 | 393 |
| Example 6 | 25 | 24 | 21 | 15 | 13 | <1 | 342 |
| Example 7 | 5 | 6 | 3 | −2 | 3 | <1 | 403 |
| Example 8 | 7 | 3 | −4 | 2 | 4 | <1 | 385 |
| Example 9 | 2 | 6 | −2 | 1 | 2 | <1 | 412 |
| Example 10 | 18 | 14 | 12 | 8 | 9 | <1 | 403 |
| Example 11 | 2 | 4 | −5 | 3 | 1 | <1 | 398 |
| Example 12 | 10 | 12 | 7 | 9 | 7 | <1 | 379 |
| Example 13 | 21 | 18 | 10 | 15 | 12 | <1 | 404 |
| Example 14 | 26 | 20 | 14 | 19 | 16 | 19 | 405 |
| Example 15 | 19 | 18 | 10 | 14 | 15 | <1 | 403 |
| Example 16 | 23 | 19 | 15 | 9 | 13 | <1 | 346 |
| Example 17 | 18 | 20 | 15 | 14 | 6 | <1 | 387 |
| Example 18 | 23 | 15 | 10 | 16 | 10 | <1 | 402 |
| Example 19 | 20 | 16 | 13 | 9 | 14 | <1 | 397 |
| Example 20 | 6 | 5 | 8 | −2 | 1 | <1 | 435 |
| Comparative Example 1 | 40 | 38 | 30 | 26 | 35 | <1 | 261 |
| Comparative Example 2 | 48 | 39 | 31 | 24 | 25 | <1 | 274 |
| Comparative Example 3 | 57 | 54 | 46 | 37 | 34 | <1 | 258 |
| Comparative Example 4 | 38 | 42 | 36 | 28 | 27 | <1 | 256 |
| Comparative Example 5 | 18 | 21 | 19 | 21 | 17 | 84 | 399 |
| Comparative Example 6 | 21 | 24 | 20 | 24 | 19 | 561 | 418 |
| Comparative Example 7 | 24 | 27 | 29 | 26 | 21 | 359 | 350 |

In Examples 1 to 20, high strength of 300 MPa or more were obtained and the number of precipitates having a diameter of 30 to 1000 nm in a microstructure was 20 or less per 100 $\mu m^2$. Also, the difference between the Charpy impact energy value measured without charging with hydrogen and the Charpy impact energy value measured after charging with hydrogen was 30 J or less in all temperature ranges.

On the contrary, in Comparative Example 1, the difference between the Charpy impact energy value measured without charging with hydrogen and the Charpy impact energy value measured after charging with hydrogen exceeded 30 J in all temperature ranges because the austenite structure was unstable. Also, it was confirmed that the specimen of Comparative Example 1 was not suitable for use in a hydrogen environment due to a low yield strength of 300 MPa or less.

In Comparative Examples 5 to 7, the number of precipitates was exceeded 20 per 100 $\mu m^2$, and thus strengths of 300 MPa or more were obtained. However, referring to Table 2, low Charpy impact energy values were obtained at −196° C. in both cases of hydrogen-charged specimens and uncharged specimens. This is because, improvement of strength by precipitates involves deterioration of toughness in a low temperature environment.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

The austenitic stainless steel according to the present disclosure has high impact toughness in a cryogenic environment and improved low-temperature toughness in a hydrogen environment, and thus may be industrially applicable as a material for a gaseous and liquid hydrogen environment.

The invention claimed is:

1. An austenitic stainless steel in a hydrogen environment comprising, in percent by weight (wt %), 0.1% or less of C, 1.5% or less of Si, 0.5 to 3.5% of Mn, 17 to 23% of Cr, 8 to 14% of Ni, 0.15 to 0.3% of N, and the balance of Fe and impurities, and optionally further comprising at least one of 2% or less of Mo, 0.2 to 2.5% of Cu, 0.05% or less of Nb, and 0.05% or less of V, wherein the number of precipitates having an average diameter of 30 to 1000 nm and distributed in a microstructure is less than 1 per 100 $\mu m^2$, and wherein a Charpy impact energy value, measured at −196° C. after charging hydrogen into the steel material at 300° C. and at 10 MPa, is 100 J or more; wherein a yield strength at room temperature is 300 MPa or more; wherein a difference between a first Charpy impact energy value measured without charging with hydrogen at a temperature below −50° C.

and a second Charpy impact energy value measured after charging with hydrogen at 300° C. and at 10 MPa is 30 J or less.

* * * * *